US005950254A

United States Patent [19]

Yasue

[11] Patent Number: 5,950,254

[45] **Date of Patent: *Sep. 14, 1999**

[54] PORTABLE SAUNA

[75] Inventor: Nobuhiro Yasue, Nakatsugawa, Japan

[73] Assignee: Kabushiki Kaisha Keibi Seisakusho, Gifu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/599,732

[22] Filed: Feb. 12, 1996

[30] Foreign Application Priority Data

May 11, 1995 [JP] Japan ..... 7-113369

[51] Int. Cl.[6] ..... A61H 33/06

[52] U.S. Cl. ..... 4/524; 4/527

[58] Field of Search ..... 4/524–534

[56] References Cited

FOREIGN PATENT DOCUMENTS

| | | | |
|---|---|---|---|
| 0288158 | 3/1988 | European Pat. Off. | A61H 33/06 |
| 0300577 | 7/1988 | European Pat. Off. | A61H 33/06 |
| 0300577 | 1/1989 | European Pat. Off. | 4/531 |
| 3239049 | 5/1984 | Germany | A61H 33/06 |
| 3511436 | 10/1986 | Germany | A61H 33/06 |
| 3728378 | 2/1988 | Germany | A61H 33/06 |
| 9303834 | 3/1993 | Germany | A61H 33/06 |
| 56-54721 | 10/1979 | Japan . | |
| 4-256752 | 2/1991 | Japan . | |
| 4009157 | 1/1992 | Japan | 4/524 |
| 4141169 | 5/1992 | Japan | 4/524 |
| 5-317377 | 5/1992 | Japan . | |
| 6-181965 | 7/1994 | Japan . | |
| 6-319780 | 11/1994 | Japan . | |
| 6-327742 | 11/1994 | Japan . | |
| 7-475 | 1/1995 | Japan . | |
| 7-289605 | 11/1995 | Japan . | |
| 7-313569 | 12/1995 | Japan . | |
| 90/01918 | 8/1989 | WIPO | A61H 33/06 |

*Primary Examiner*—Charles E. Phillips
*Attorney, Agent, or Firm*—Limbach & Limbach L.L.P.

[57] ABSTRACT

A sauna having a substantially airtight room and a heating device is described. The heating device supplies heated air into the room. The sauna includes memory, a detector, and a controller. The memory stores a maximum value and a minimum value of a number of temperature ranges for the room. One temperature range is selected by the user. The detector detects the temperature in the room. The controller selectively activates and deactivates the heating device. The controller deactivates the heating device to lower the temperature of the heated air when the temperature in the room reaches the maximum value of the selected range, and activates the heating device to raise the temperature of the heated air when the temperature in the room reaches the minimum value of the selected range.

9 Claims, 13 Drawing Sheets

| Mode No. | Min. Temperature | Max. Temperature | Cycle Time |
|---|---|---|---|
| 1 | 40℃ | 46℃ | 3min. |
| 2 | 41℃ | 47℃ | 4min. |
| 3 | 42℃ | 48℃ | 5min. |
| 4 | 43℃ | 49℃ | 5min.30sec. |
| 5 | 44℃ | 50℃ | 6min. |
| 6 | 45℃ | 51℃ | 7min. |

PORTABLE SAUNA

BACKGROUND OF THE INVENTION

1. Field of the Invention

The present invention relates to a sauna, and more particularly to a portable sauna which is capable of automatically adjusting its temperature.

2. Description of the Related Art

The advantageous effects that a sauna has on health is well known. Sauna kits that may be used in normal households have been developed. Such saunas generally have a tent-like cover held on a frame. The inside is warmed by an air heater, and a blower sends the heated air inside the cover. The user sits inside and is exposed to the heated air. The user's head protrudes from the cover and the user's arms may also extend outside the cover.

The applicant of the present invention has disclosed such a sauna in Japanese Unexamined Patent Publication 7-313569. As shown in FIG. 14, the sauna has a chair 202 and a foot rest 203, which are arranged in a rectangular frame 201. The frame 201 is covered by a waterproof sheet 204. A heating device (not shown) heats air and sends the heated air into the sauna to raise the temperature therein. The user of the sauna sits on the chair 202 in the sauna. A head rest 205 and a back rest 206 are provided on the chair 202 to make the chair 202 more comfortable.

When the temperature inside the sauna changes and becomes too high or too low, the user operates a switch to adjust the temperature. Thus, there are cases in which the user is required to manually operate the switch a number of times until he or she finds an appropriate temperature. This is troublesome for the user.

SUMMARY OF THE INVENTION

It is an objective of the present invention to provide a sauna capable of automatically adjusting its temperature to a value adequate for a sauna.

Another objective of the present invention is to provide a sauna which allows the user to adjust the temperature of the sauna to a value preferable to the user.

A further objective of the present invention is to provide a sauna which is capable of uniformly warming the interior of the sauna and ensure a comfortable sauna to the user.

Still another objective of the present invention is to provide a sauna which has a highly effective heating capability.

To achieve these objectives, a sauna having a substantially airtight room and a heating device is provided. The heating device serves to supply heated air to the room. The sauna includes memory, a detector, and a controller. The memory stores a maximum value and a minimum value of a temperature range of the room. The detector detects the temperature in the room. The controller selectively activates and deactivates the heating device. The controller deactivates the heating device to lower the temperature of the heated air when the temperature in the room reaches the maximum value, and activates the heating device to raise the temperature of the heated air when the temperature in the room reaches the minimum value.

BRIEF DESCRIPTION OF THE DRAWINGS

The features of the present invention that are believed to be novel are set forth with particularity in the appended claims. The invention, together, with objects and advantages thereof, may best be understood by reference to the following description of the presently preferred embodiment together with the accompanying drawings in which:

FIG. 4(*b*) is an enlarged perspective view showing a pipe that draws heated air into the sauna with a structure that disperses the air current;

FIG. 4(*c*) is a diagrammatic cross-sectional view showing the structure of FIG. 4(*b*) in which the air current is dispersed in three directions;

DETAILED DESCRIPTION OF THE PREFERRED EMBODIMENT

Figure 1:
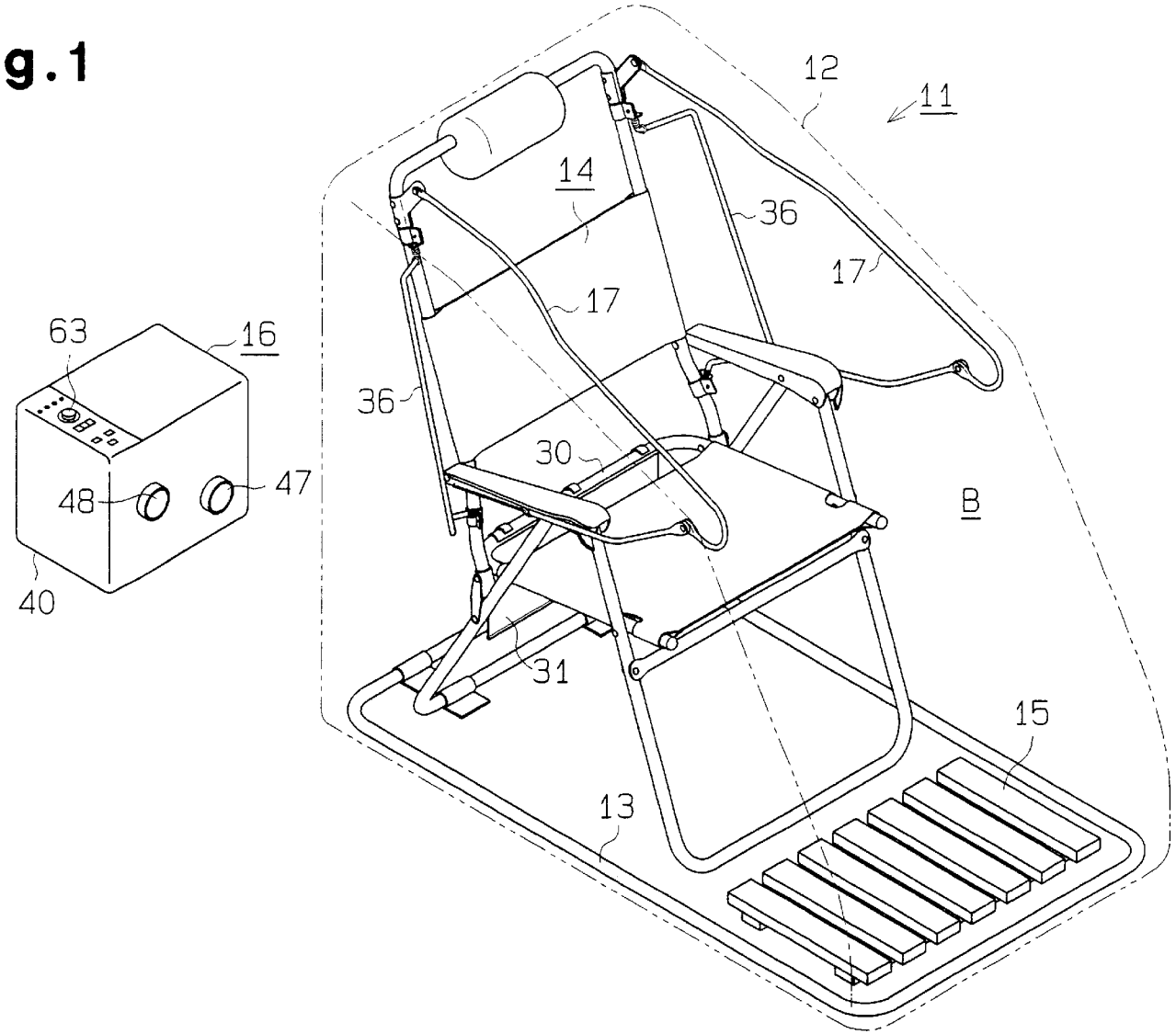
FIG. 1 is a perspective view showing the interior of a sauna according to the present invention.

As shown in FIG. 1, a sauna 11 includes a cover sheet 12, a frame 13, a chair 14, a foot rest 15, and a heating device 16, which heats air. A substantially airtight sauna room B is defined inside the bag-shaped sheet 12. The outer surface of the sheet 12 is made of a soft material while the inner surface of the sheet 12 is made of a copper fiber, which is waterproof and disinfects.

Figure 2:
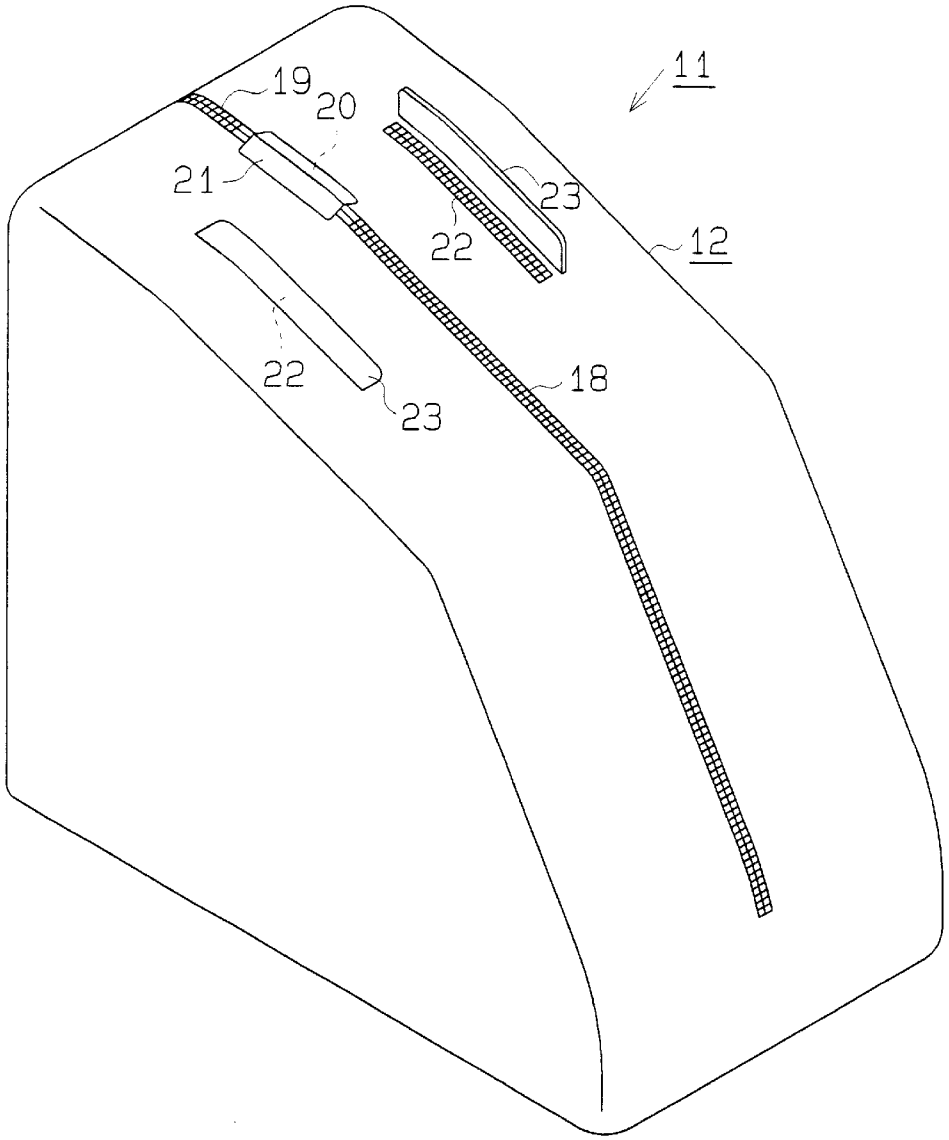
FIG. 2 is a perspective view showing the exterior of the sauna.

As shown in FIG. 2, a first fastener 18 and a second fastener 19, provided at the middle of the sheet 12, divide the sheet 12 into two sections. The user unfastens both fasteners 18, 19 to get into the sauna room B. A slit 20 is provided between the two fasteners 18, 19. When the user is in the sauna room B, his or her head is protruded from the slit 20. A lid 21 closes the slit 20 when the sauna 11 is not in use.

An opening 22 is provided on each side of the slit 20. The openings 22 allows the user to extend his arms from the sauna room B to read a book or manipulate various switches of the sauna 11. Lids 23 close each opening 22 when the user's arms are not extended from the sauna room B or when the sauna 11 is not in use.

Figure 3:
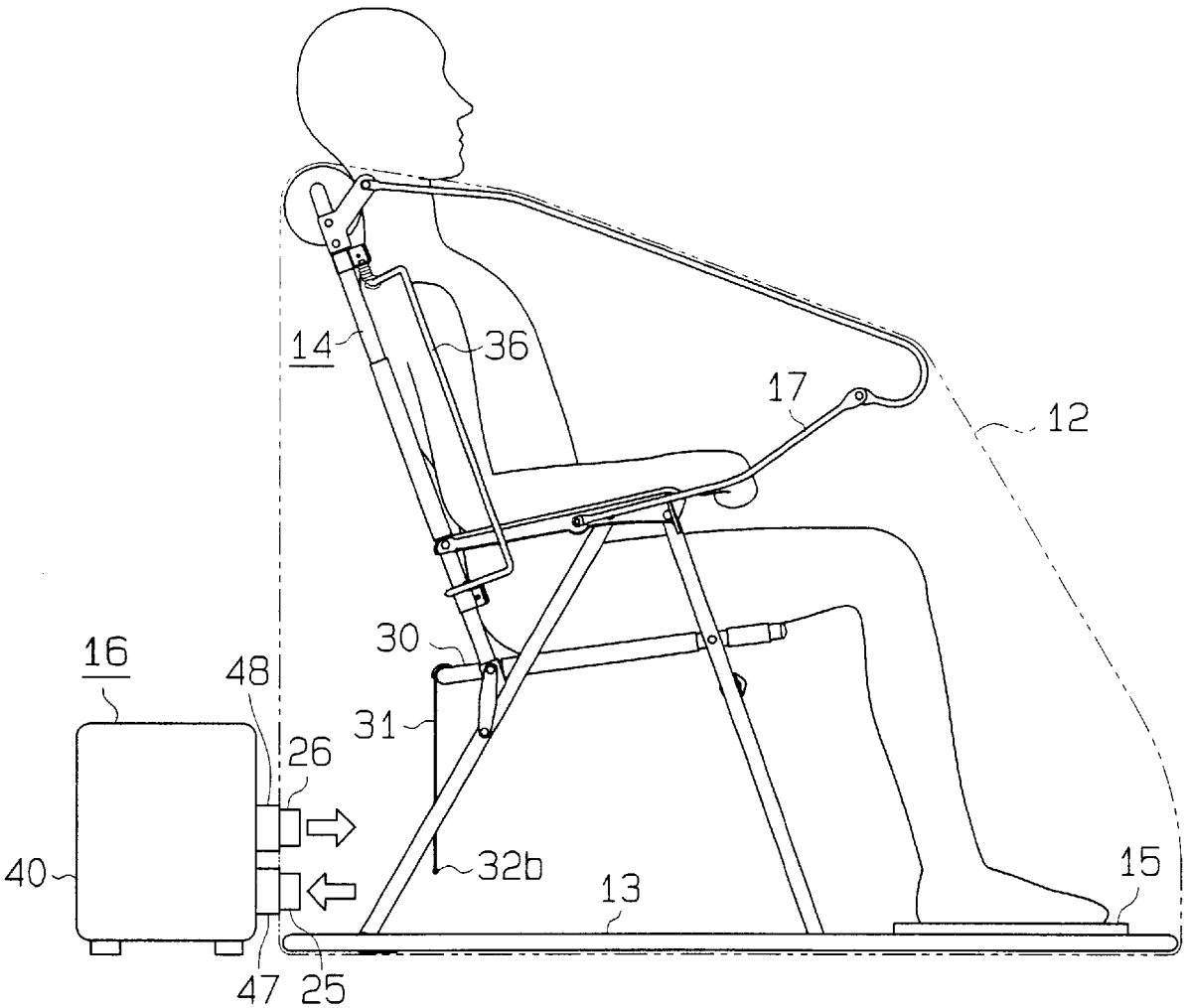
FIG. 3 is a side view showing the sauna with a user sitting therein.
Figure 4:
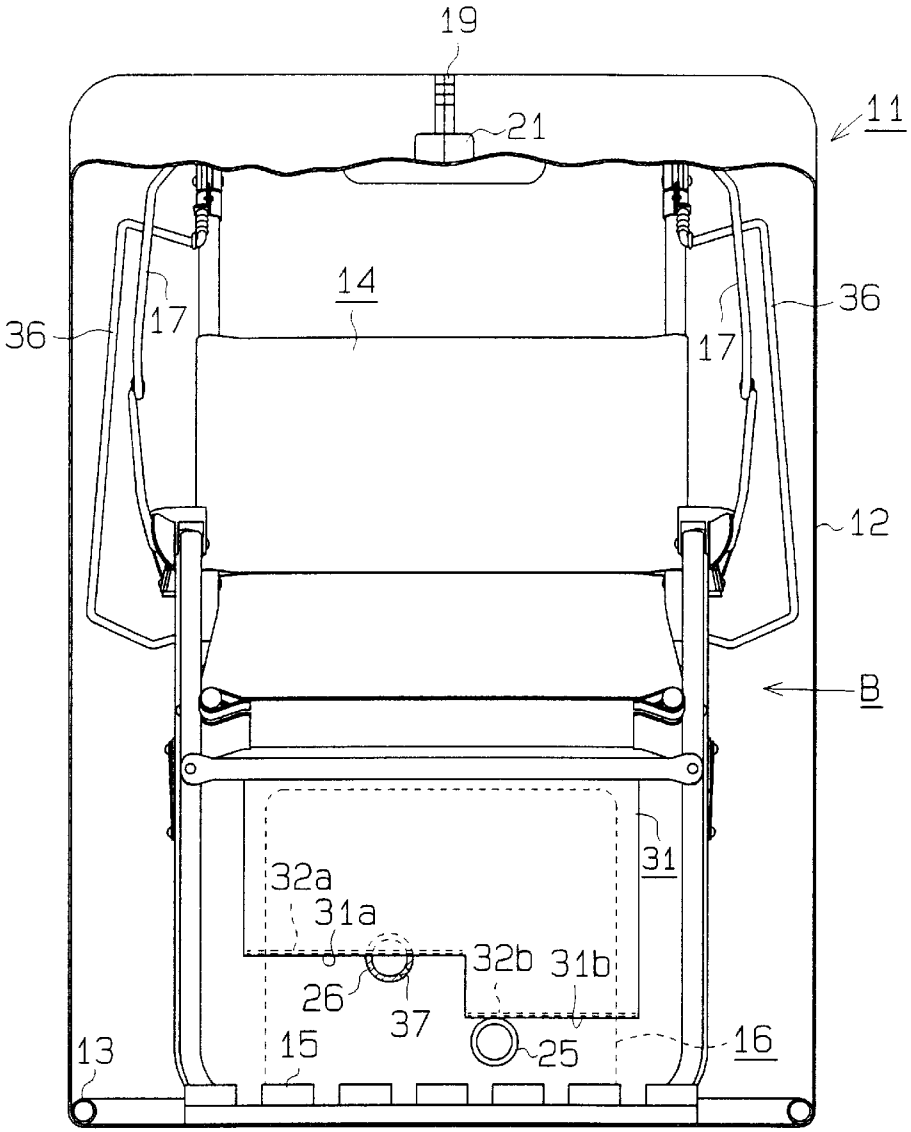
FIG. 4(*a*) is a front view with parts cut away showing the interior of the sauna.
Figure 4B:
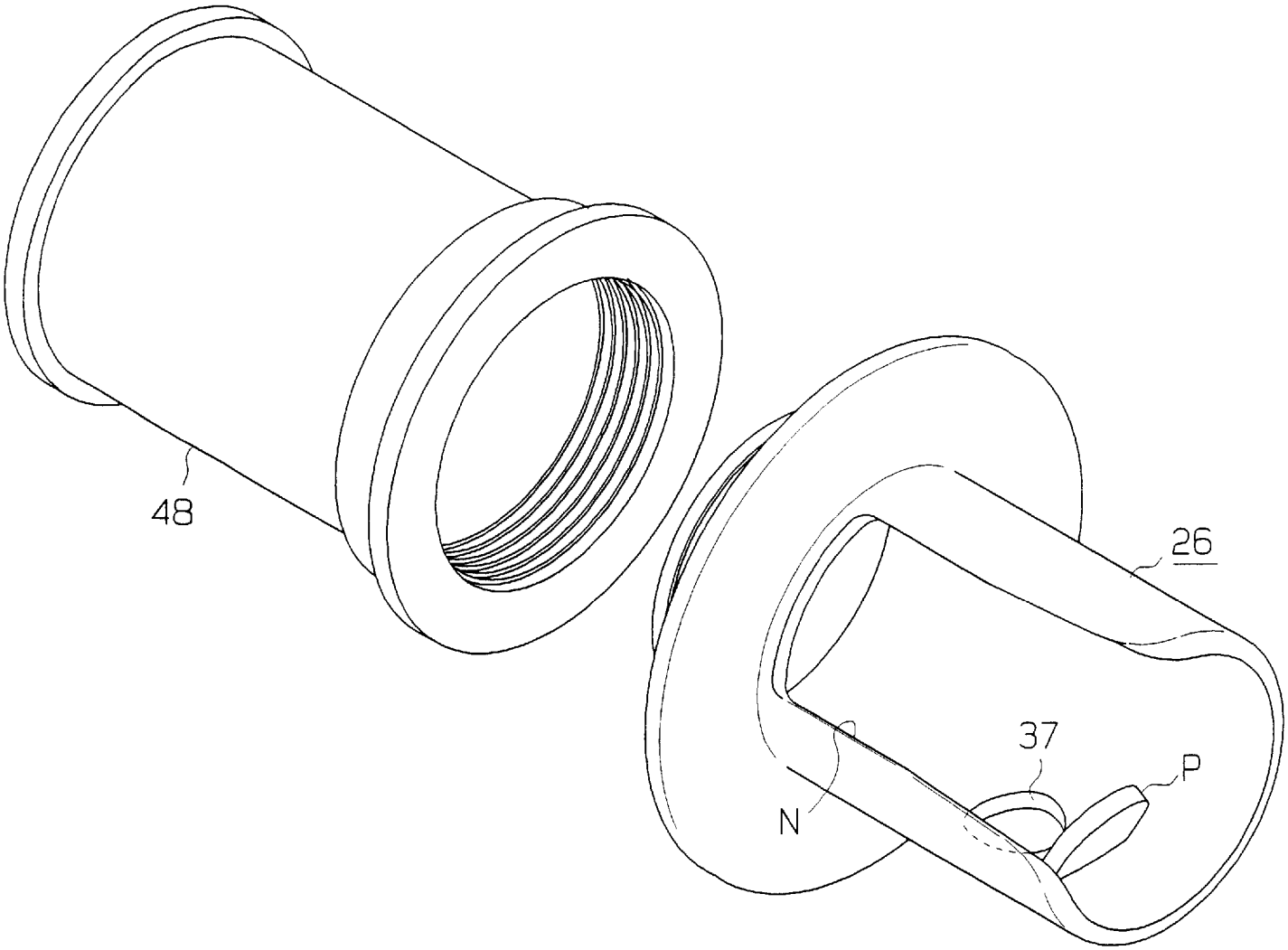
Figure 4C:
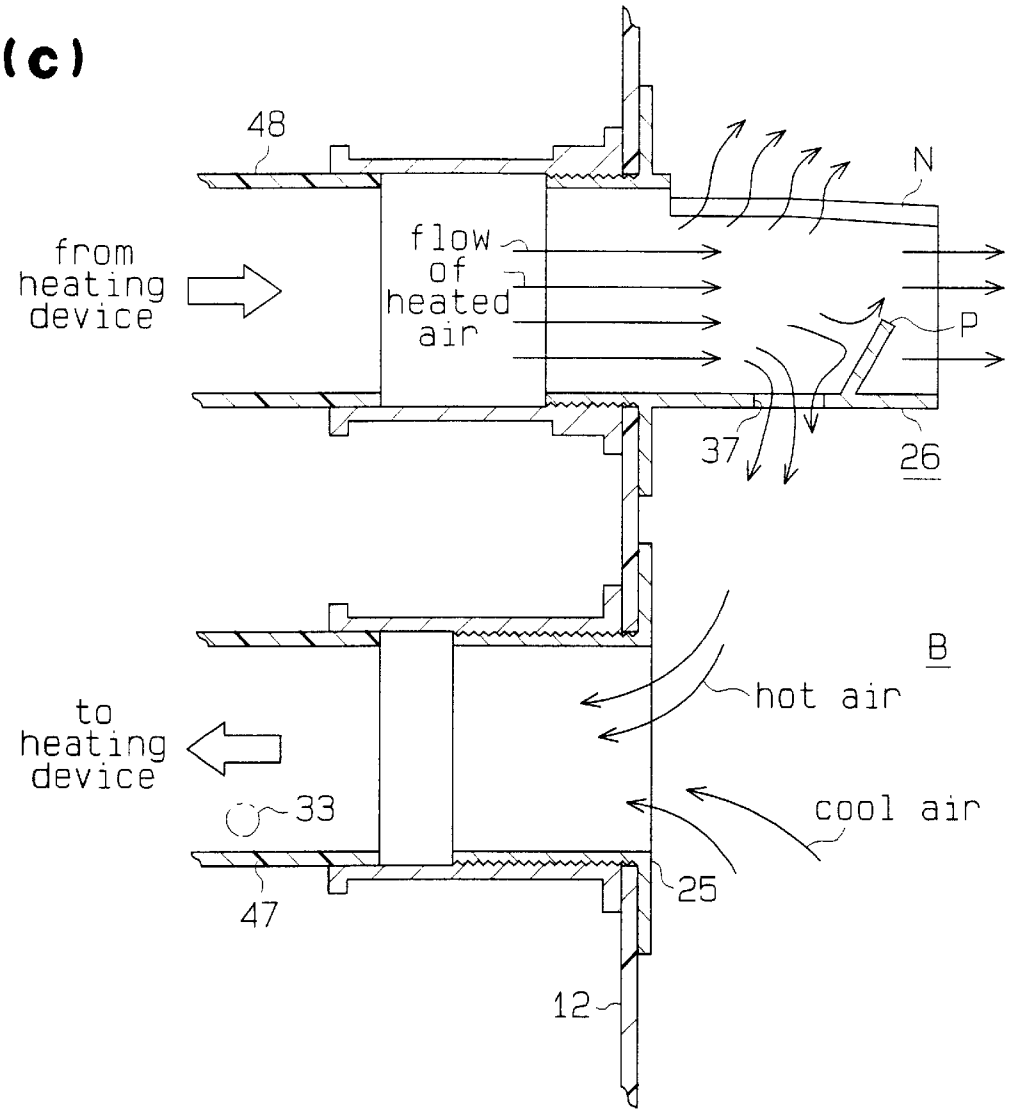

As shown in FIGS. 3 and 4(*a*), a discharge duct 25 and an intake duct 26, located above the discharge duct 25, are provided at the rear side of the sheet 12. The ducts 25, 26 communicate the sauna room B with the heating device 16. The air heated in the heating device 16 is conveyed into the sauna room B through the intake duct 26 by a blower, or the like. After warming the sauna room B, the heated air is returned to the heating device 16 through the discharge duct. 25. This air circulation is continued until the temperature inside the sauna room B reaches a value appropriate for a sauna.

As shown in FIG. 4(*b*), a notch N is formed in the upper peripheral wall of the intake duct 26, and a through hole 37 is formed in the lower peripheral wall of the duct 26 faced toward the discharge duct 25. An inclined plate P projects from the inner peripheral wall of the duct 26 at the distal side, or the sauna room B side, of the through hole 37. The plate P is inclined toward the distal end of the duct 26.

As shown in FIG. 4(*c*), the plate P disperses the flow of the heated air from the heating device 16 into three currents, each directed toward different directions, in the intake duct 26. The heated air introduced into the sauna room B from the notch N ascends inside the room B and warms the user's waist and back. The heated air introduced into the sauna room B from the distal end of the intake duct 26 warms the user's legs. Accordingly, the structure of the intake duct 26 enables the interior of the sauna room B to be uniformly warmed and ensures the user's comfort.

The through hole 37 is defined at a location which is optimum for the heated air from the hole 37 to be drawn into the discharge duct 25. Heat exchange conducted in the sauna room B lowers the temperature of the air returning to the heating device 16. The rather cool air, returning from the sauna room B, and the rather hot air, injected from the through hole 37, are combined into a rather warm air and returned to the heating device 16. This allows the heating efficiency to be upgraded. This circulation is continued to gradually raise the temperature of the air sent into the sauna room B from the heating device 16.

As shown in FIG. 1, the frame 13 is placed on the inner surface of the bottom of the sheet 12. The foot rest 15 is located inside the frame 13 at the front section. The chair 14 is located inside the frame 13 behind the foot rest 15. Rods 17 are provided at each side of the chair 14 to hold the sheet 12 and define the sauna room B. Rods 36 are provided at each rear lateral side of the chair 14 to adjust the tension acting on the sheet 12.

As shown in FIGS. 3 and 4(*a*), a screen 31 hangs from a pipe 30 at the rear side of the chair 14 to adjust the direction of the heated air current. It is required that the screen 31 be made of a material which has flexibility. In the preferred and illustrated embodiment, a vinyl sheet is used as the material for the screen 31. The screen 31 has an upper base 31*a* and a lower base 31*b*. When being assembled, the upper base 31*a* is set at a height that is substantially the same as the height of the center of the intake duct 26. The lower base 31*b* is set at a height that is substantially the same as the height of the highest portion of the discharge duct 25. Rod-shaped weights 32a, 32b are attached to the bases 31*a*, 31*b*, respectively, to apply an adequate tension on the screen 31. The screen 31 interferes with the heated air injected into the sauna room B from the intake duct 26 and causes the air to be dispersed with the higher base 31*a* acting as a boundary of the dispersed currents. One of the currents is directed upward toward the user's waist by the screen 31 and the other current flows forward toward the user's legs without interference with the screen 31. Thus, one of the three heated air currents, which are produced in the intake duct 26, is further dispersed into two currents. This further enhances the heating effect in which the entire interior of the sauna room B is uniformly heated.

The heating device 16 will now be described.

Figure 5:
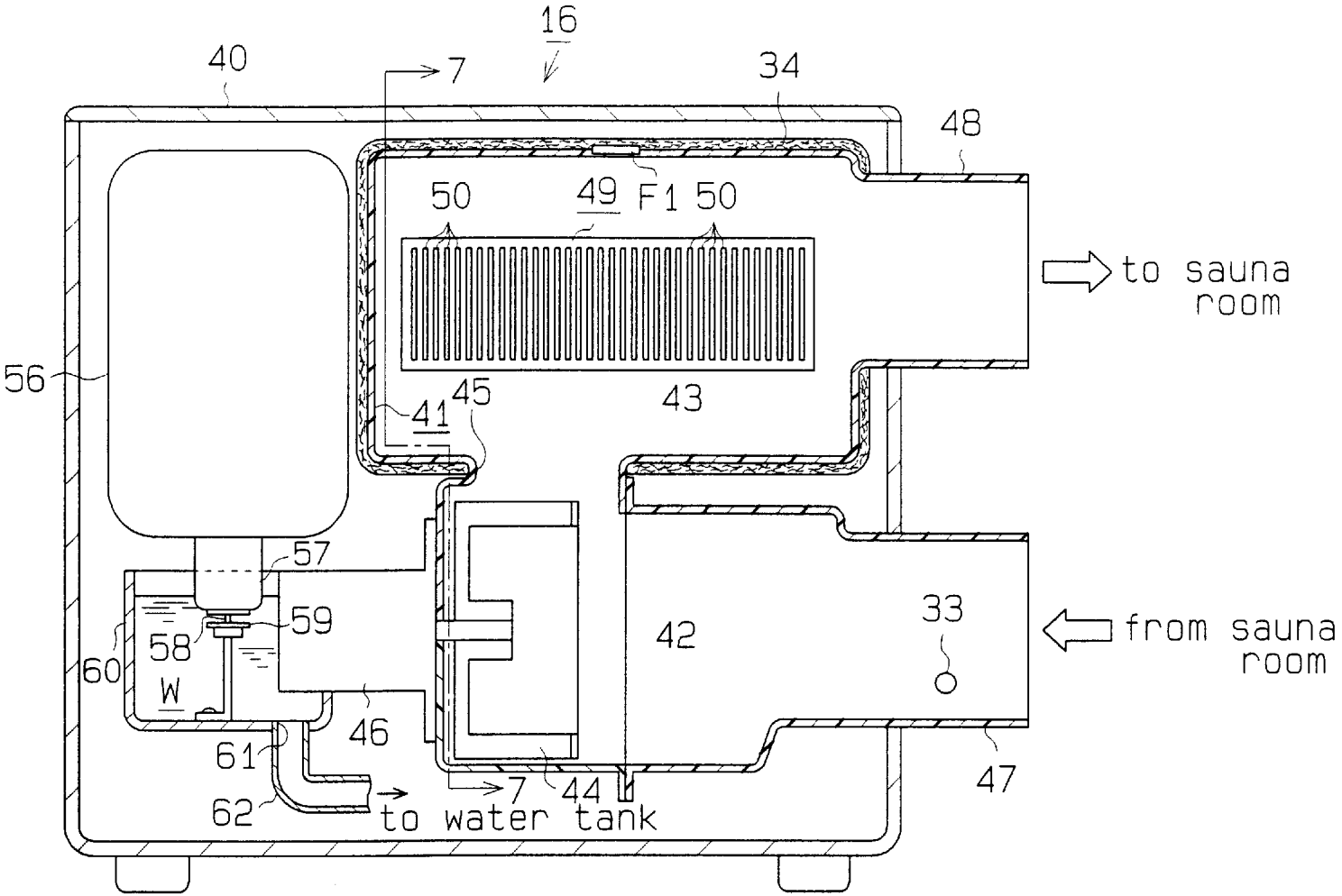
FIG. 5 is a side diagrammatic cross-sectional view showing a heating device. A first chamber which accommodates a sirocco fan and a second chamber which accommodates a fan for heated air is illustrated.
Figure 6:
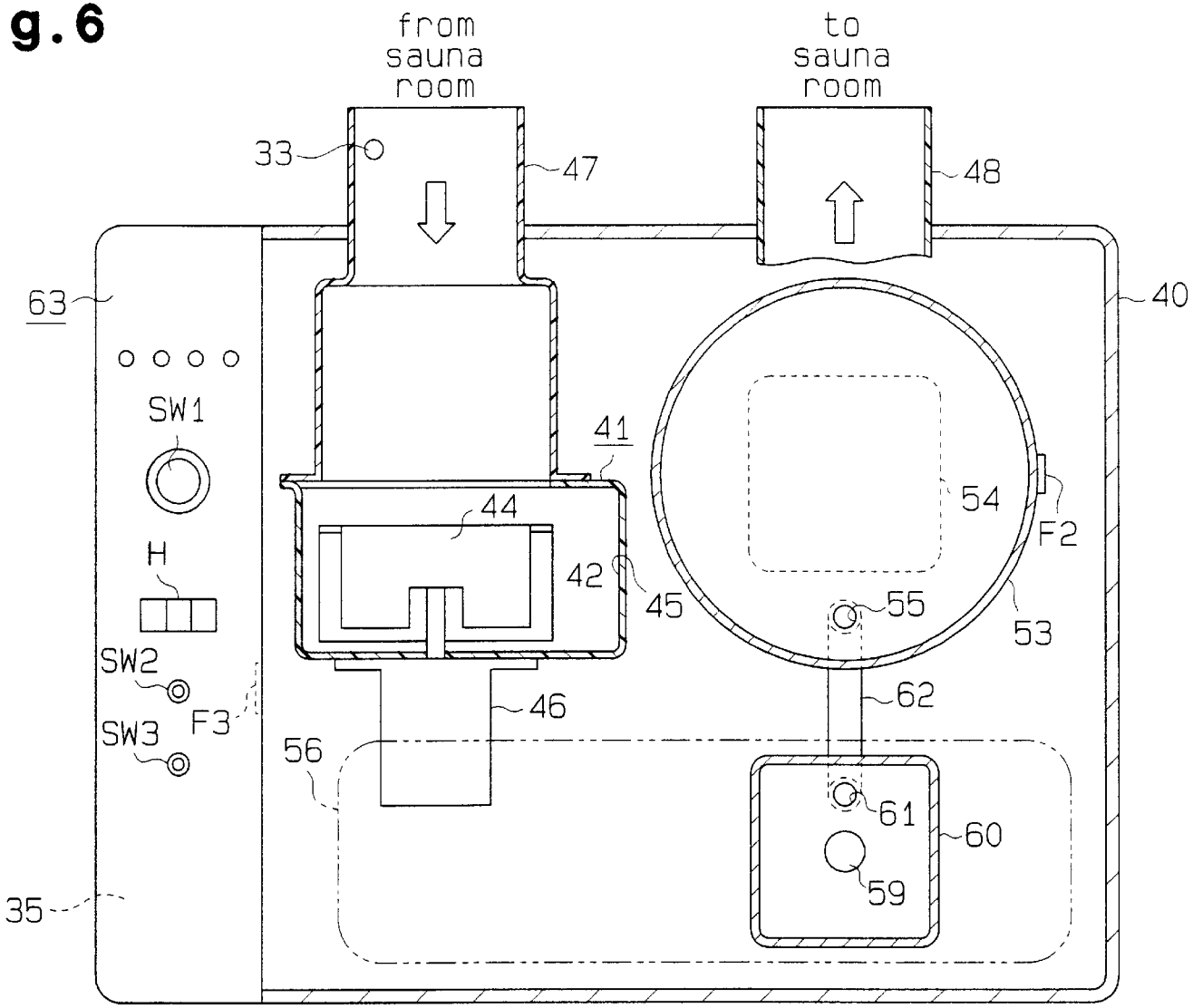
FIG. 6 is a top diagrammatic cross-sectional view showing the heating device. Although the first chamber is shown, the second chamber is omitted from the drawing.
Figure 7:
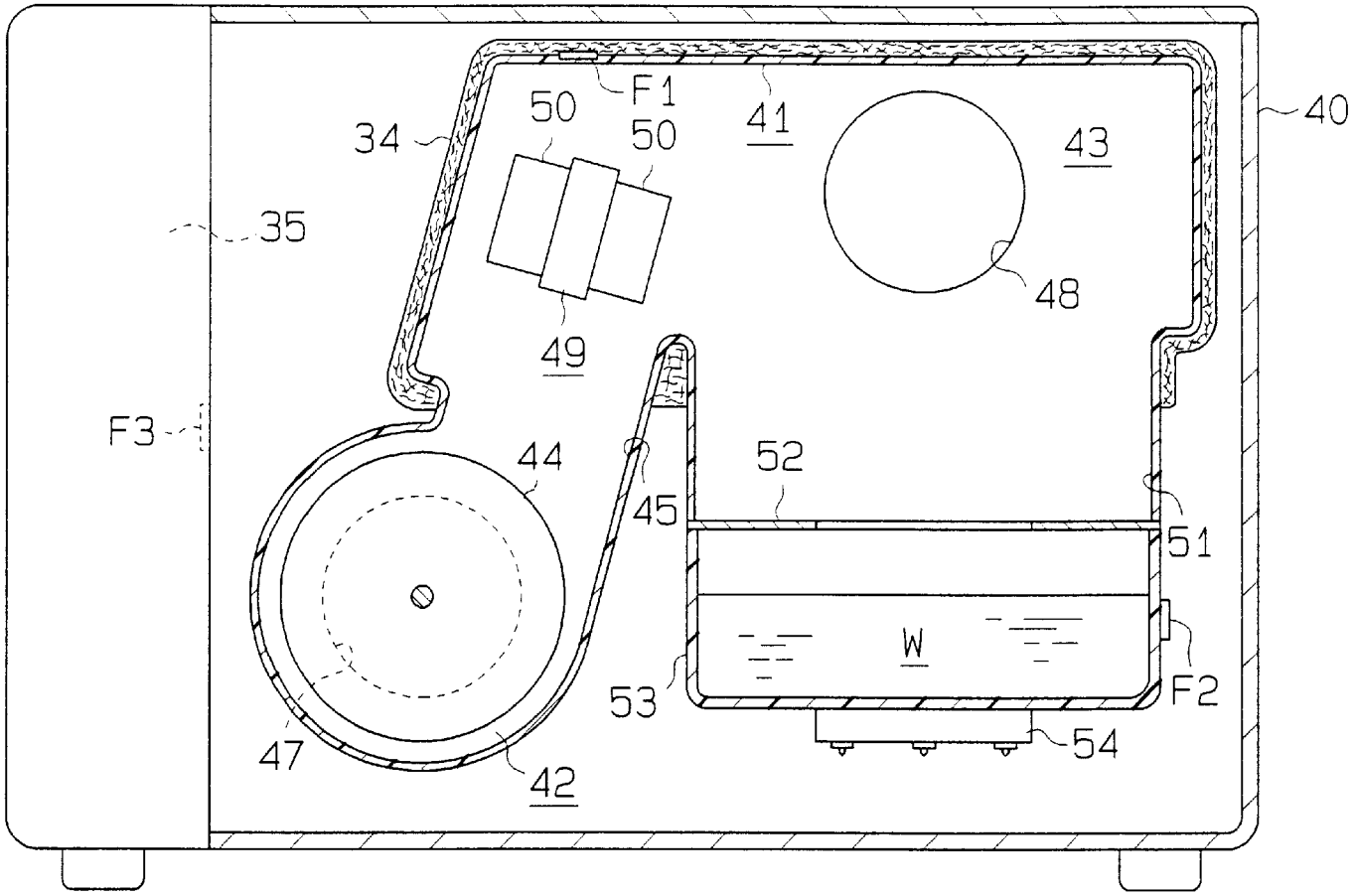
FIG. 7 is a diagrammatic cross sectional view of FIG. 5 along line 7—7, showing a water tank communicated with the second chamber.

As shown in FIGS. 5 to 7, a manifold 41 is provided in a case 40. The manifold 41 is made of a synthetic resin material, which is highly heat-resistant. In the preferred embodiment, the manifold 41 is formed from a melanin-based resin, which resists heat up to approximately 200 degrees Celsius. The manifold 41 includes a first chamber 42 and a second chamber 43. The two chambers 42, 43 are connected to each other by an opening 45. The first chamber 42 accommodates a sirocco fan 44, which is driven by a motor 46. An inlet pipe 47, the axis of which is aligned along the rotary axis of the sirocco fan 44, is connected to the first chamber 42.

An outlet pipe 48, which extends in the same direction as the inlet pipe 47, is connected to the second chamber 43. As shown in FIG. 4(*c*), the inlet pipe 47 projects externally from the case 40 and is connected to the discharge duct 25 provided in the sheet 12. As shown in FIGS. 4(*b*) and(*c*), the outlet pipe 48 also projects from the case 40 and is connected to the intake duct 26 provided in the sheet 12.

A temperature sensor 33, consisting of a thermistor or the like, is mounted to the inner wall of the inlet pipe 47. Rotation of the sirocco fan 44 causes the air in the sauna room B to be drawn into the first chamber 42 through the discharge duct 25 and the inlet pipe 47 together with the air from the intake duct 26 and the outlet pipe 48. The temperature sensor 33 detects the temperature of the air passing through the inlet pipe 47, that is, the temperature inside the sauna room B.

Figure 9:
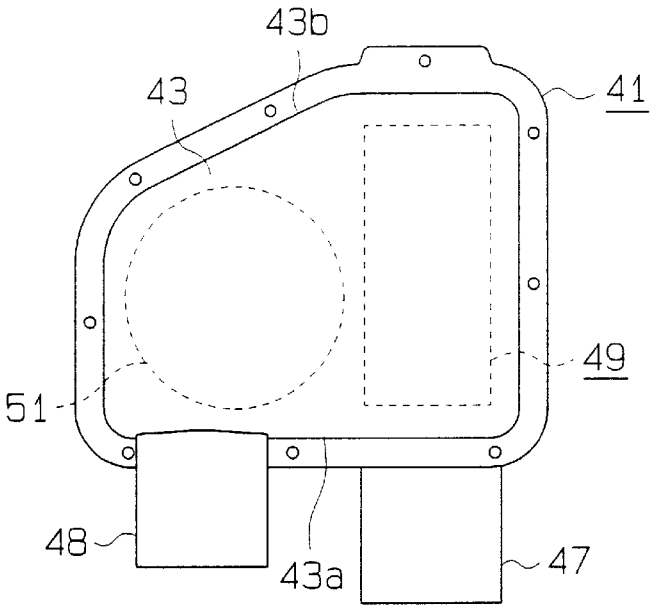
FIG. 9 is a top,plan view of the manifold.
Figure 8:
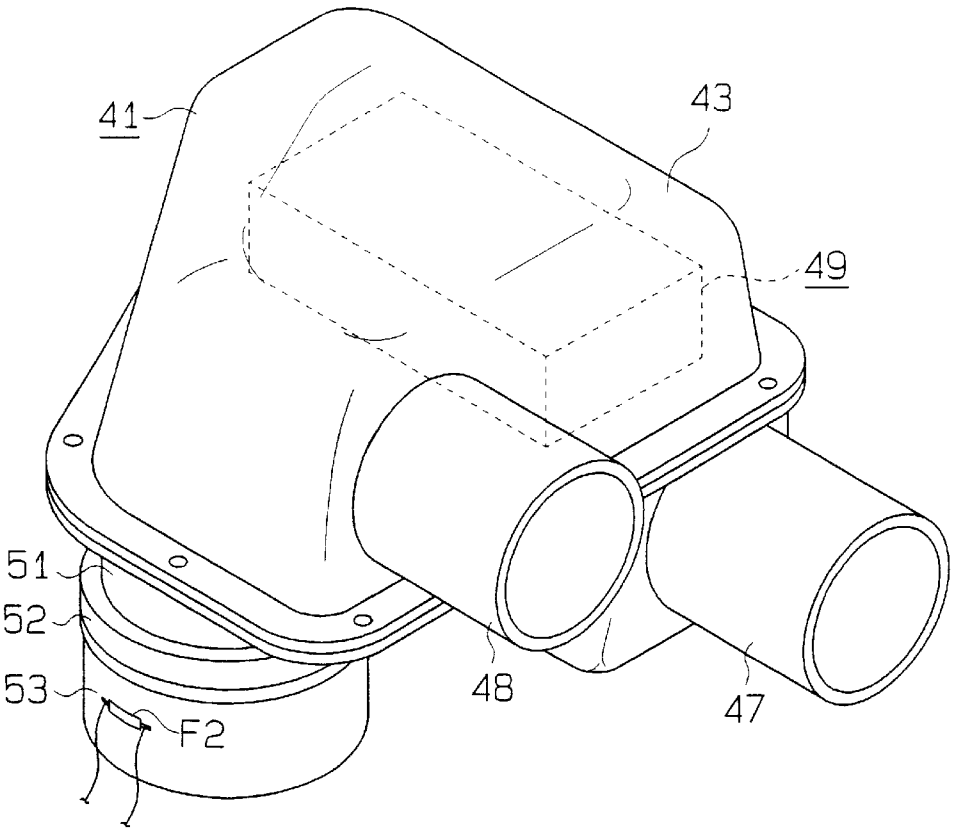
FIG. 8 is a perspective view of a manifold provided in the heating device.

As shown in FIG. 5, a ceramic heater 49 is provided in the second chamber 43 to heat air. The heater 49 has a plurality of fins 50 that are arranged in parallel. As shown in FIGS. 8 and 9, walls 43*a* and 43*b* are opposed to each other inside the second chamber 43 near the outlet pipe 48. The wall 43*b* is inclined toward the wall 43*a* in a manner that the area between the walls 43*a*, 43*b* becomes narrow as they approach an aperture 51 from where steam is drawn in. The outer walls of the second chamber are encompassed by a heat insulating cover 34, which is made of glass fibers or the like.

By forming the second chamber 43 into a shape, the cross-sectional area of which becomes smaller as it approaches the side where steam is drawn in, the air heated by the heater 49 and the steam introduced into the second chamber 43 through the aperture 51 are efficiently mixed. This allows steam and heated air to be efficiently supplied to the second chamber 43. In addition, the shape of the second chamber 43 increases the injection velocity of the heated air and results in the heated air being efficiently injected from the outlet pipe 48.

By encompassing the manifold 41, which accommodates the heater 49, with the heat insulating cover 34, heat escaping from the inside of the manifold 41 is suppressed. This improves thermal insulation inside the manifold 41. As a result, air is efficiently heated. This leads to a reduction in consumption of electric power. Furthermore, the effects on external parts that heat may inflict is small. Thus, problems, described below, which may be caused by the heat, are prevented.

A fuse F1 is arranged between the second chamber 43 and the heat insulating cover 34. The fuse F1 melts and stops the flow of electric current when the current of the heating device 16 becomes excessive. The fuse F1 also melts when the temperature reaches approximately 180 degrees Celsius even if there is no excess current. The fuse F1 prevents damages from being inflicted on the manifold 41 and its peripheral devices. For example, a malfunction of the motor 46 (e.g., burnout of the motor 46) will reduce the amount of air supplied to the second chamber 43. This may lead to excessive heating of the heater 49 causing the manifold 41 to melt. However, the fuse F1 will disconnect the electric current flow before excessive heating occurs. Hence, damage to the manifold 41 and its peripheral devices, which may be caused by an electric current, is prevented.

As shown in FIG. 7, the aperture 51 at the bottom of the second chamber 43 enables steam to be drawn therethrough. The aperture 51 is communicated with a metal water tank 53 through an annular plate 52. The inner diameter of the plate 52 is smaller than the inner diameters of the aperture 51 and the water tank 53. A ceramic heater 54 is fixed to the outer bottom surface of the tank 53 to produce steam. As shown in FIG. 6, a port 55 is provided at the bottom of the tank 53. A water level sensor (not shown), which detects the level of the water inside the tank 53, is provided on the inner wall of the tank 53.

As shown in FIG. 5, a main reservoir 56, in which water W is reserved, is accommodated in the case 40. A valve stem 58 is attached to a neck 57 of the reservoir 56. A sub reservoir 60 is arranged opposed to the neck 57. When the valve stem 58 of the main reservoir 56 contacts a seat 59, mounted to the bottom of the sub reservoir 60, the valve stem 58 is pushed into the neck 57, which opens the neck 57 and allows water W to flow into the sub reservoir 60 from the main reservoir 56. To resupply the main reservoir 56, it is removed, which causes the valve stem 58 to extend. This closes the neck 57 and stops the supply of water W from the main reservoir 56 to the sub reservoir 60. A port 61 is provided in the bottom of the sub reservoir 60. As shown in FIG. 6, a pipe 62 connects the ports 61 and 55 and communicates the sub reservoir 60 with the water tank 53. Accordingly, water W is supplied to the tank 53 via the main reservoir 56 and the sub reservoir 60.

As shown in FIG. 7, a fuse F2 is provided on the outer wall of the water tank 53. The fuse F2 melts and stops the flow of electric current when the current of the heating device 16 becomes excessive. The fuse F2 also melts when the temperature reaches approximately 150 degrees Celsius even if there is no excess current. If, for example, a malfunction of the water level sensor causes the heater 54, which produces steam, to be activated without any water W in the tank 53, the fuse F2 will melt and disconnect the electric current flow when the temperature of the tank 53 becomes high (approximately 120 degrees Celsius or higher). Hence, damage to the peripheral devices of the water tank 53 is prevented.

As shown in FIGS. 1 and 6, an operation panel 63 is provided on the upper surface of the case 40. The panel 63 includes a main switch SW1, which is used to activate the apparatus, a timer switch SW2, which is used to set the duration of the sauna, a mode switch SW3, which is used to change the temperature in the sauna room B, and a display H, which displays the sauna time and the sauna room B temperature. A compartment 35, which accommodates, among other things, a controller C (to be described later), is provided under the panel 63. A fuse F3 is provided on the side wall of the compartment 35. The fuse F3 melts and stops the flow of electric current when the current of the heating device becomes excessive. The fuse F3 also melts when the temperature reaches approximately 100 degrees Celsius even if there is no excess current. Thus, the fuse F3 will melt and disconnect the electric current flow at the side wall of the compartment 35 and protect the controller C, retained inside the compartment 35, and the switches SW1, SW2, SW3 on the panel 63 when the temperature of the tank 53 becomes high (approximately 120 degrees Celsius or higher).

Figures 10, 11:
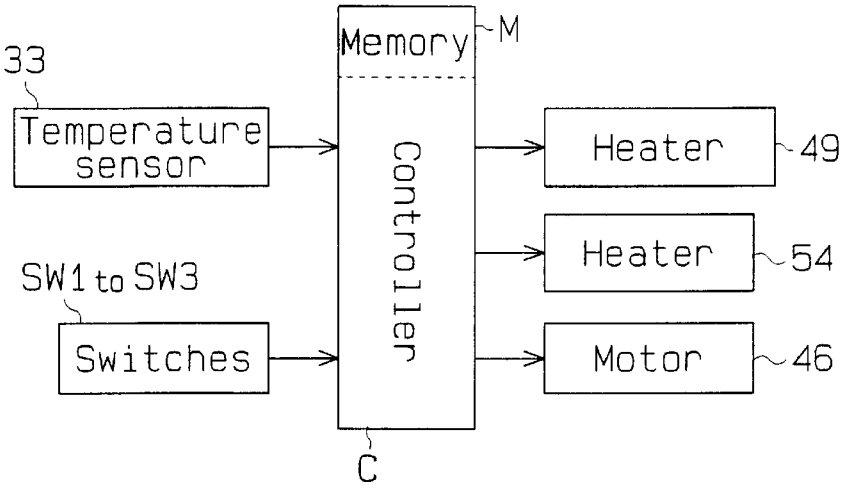
FIG. 10 is a block diagram showing the electric structure of the heating device.
FIG. 11 is a table showing the maximum and minimum temperatures of different temperature modes, memorized in a memory of a controller.

The diagrammatic structure of the heating device will now be described with reference to FIG. 10.

The temperature sensor 33 sends a signal, based on the detected temperature of the sauna room B, to the controller C. Each switch SW1, SW2, SW3 also sends a signal, based on its selected state, to the controller C. The controller C activates the heaters 49, 54 and the motor 46 according to a program, stored in its memory M, and the signals sent from the temperature sensor 33 and the switches SW1, SW2, SW3.

A plurality of modes are stored in the memory M. A minimum temperature and a maximum temperature are set in each mode. The maximum and minimum temperatures of each mode are shown in the table of FIG. 11. In mode 1, the maximum and minimum temperatures are 40 and 46 degrees Celsius. In mode 2, the maximum and minimum temperatures are 41 and 47 degrees Celsius. In mode 3, the maximum and minimum temperatures are 42 and 48 degrees Celsius. In mode 4, the maximum and minimum temperatures are 43 and 49 degrees Celsius. In mode 5, the maximum and minimum temperatures are 44 and 50 degrees Celsius. In mode 6, the maximum and minimum temperatures are 45 and 51 degrees Celsius. These modes allows the user to select a desirable temperature inside the sauna room B according to the atmospheric temperature, the user's health state, and the user's preferences.

The controller C adjusts the temperature in the sauna room B to a value within the range of the mode, selected by the mode switch SW3. The controller C activates or deactivates the air heater 49 to maintain the temperature inside the sauna room B within the range of the selected mode. For example, if mode 1 is selected by the switch SW3, the controller keeps the heater 49 activated until the temperature inside the sauna room B, detected by the temperature sensor 33, reaches 46 degrees Celsius. When the temperature inside the sauna room B reaches 46 degrees Celsius, the controller C deactivates the heater 49 to lower the temperature in the sauna room B. When the temperature in the sauna room B is lowered to 40 degrees Celsius, the controller C activates the heater 49 again and raises the temperature. The adjustment of the temperature to the range within 40 to 46 degrees Celsius is continued during the period of time set by the timer switch SW2.

As described above, a portion of the heated air from the intake duct 26 is directed toward the discharge duct 25. This heated air is mixed with the cool air, which has circulated in the sauna room B. Thus, the value of the temperature detected by the temperature sensor 33 is close to the actual temperature at the center section of the sauna room B. This allows the temperature near the center section of the sauna room B to be adjusted to a value within the range of the maximum and minimum temperatures of the mode selected by the switch SW3. Hence, the user will experience a comfortable sauna.

As described above, the controller C deactivates the heater 49 to lower the temperature in the sauna room B when the temperature in the sauna room B reaches the maximum value of the selected mode. When the temperature in the sauna room B falls to the minimum value of the selected mode, the controller C activates the heater 49 again to raise the temperature in the sauna room B. This raises and lowers the temperature in the sauna room B, periodically. As a result, the user is provided with an appropriate stimulus that improves blood circulation and metabolism.

The cycle time of each mode is memorized in the memory M. For example, the cycle time of mode 1 is set: at 3 minutes. When mode 1 is selected by the switch SW3, the heater 49 is deactivated by the controller C if the temperature in the sauna room B does not reach the maximum value, or 46 degrees Celsius, within 3 minutes. In other words, cycle time is the period of time during which the heater 49 is activated. The cycle time prevents the heater 49 from being continuously activated when a low temperature outside the sauna room B keeps the temperature inside the sauna room B from reaching the maximum value. Thus, the temperature in the sauna room B is raised and lowered, periodically, even when the atmospheric temperature is low. As a result, the user is provided with adequate heat regardless of the atmospheric temperature being low. If the temperature in the sauna room B remains below the minimum value regardless of the heated air being sent therein, the controller C disregards the cycle time and sustains the heater 49 in an activated state.

Figure 12:
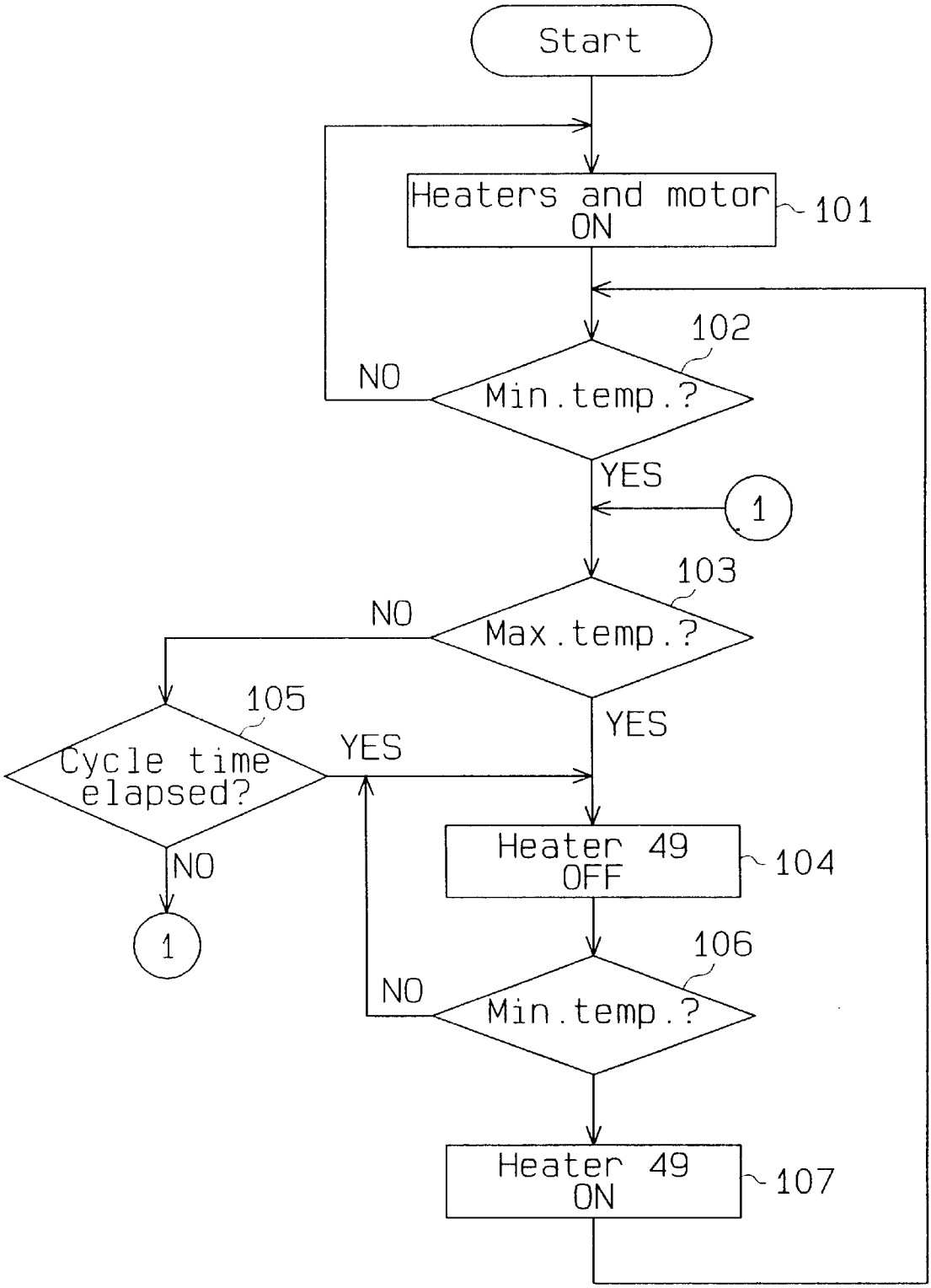
FIG. 12 is a flow chart showing a program used by the controller to activate the heating device.
Figure 13:
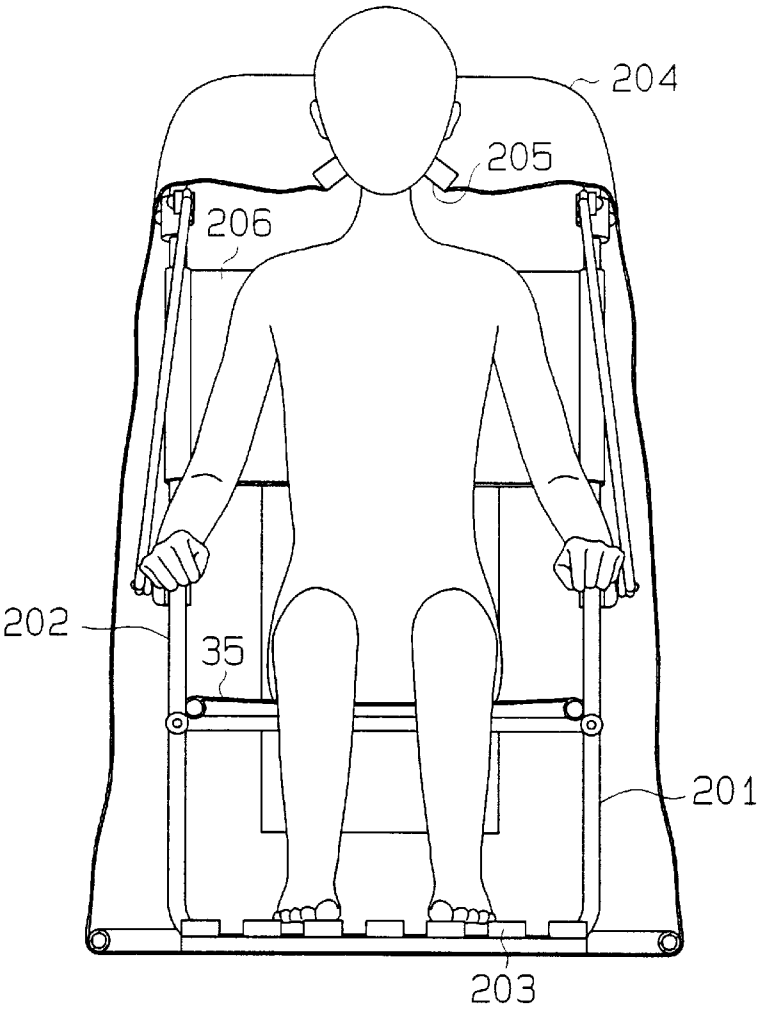
Fig.13 (Prior Art)
FIG. 13 is a partial front view showing a prior art sauna with parts cut away.

FIG. 12 is a flow chart showing a processing routine executed by the controller C. When the main switch of the apparatus is turned on, step 101 is executed to activate the heaters 49, 54 and the motor 46. The preferable mode is selected by the mode switch SW3 beforehand. Actuation of the heaters 49, 54 and the motor 46 sends heated air into the sauna room B and raises its temperature.

In step 102, it is judged whether the temperature in the sauna room B has reached the selected models minimum temperature or not. If the temperature in the sauna room B has not reached the minimum temperature, the controller C keeps the heaters 49, 54 and the motor 46 in an activated state until the temperature reaches the minimum value, regardless whether the cycle time has elapsed. If the temperature in the sauna room B has reached the minimum value, the controller C proceeds to step 103. In step 103, the controller C judges whether the temperature in the sauna room B has reached the selected mode's maximum value or not. If the controller C determines that the temperature in the sauna room B has reached the maximum value, the controller proceeds to step 104 and deactivates the air heater 49. This lowers the temperature in the sauna room B. In step 103, if the controller C determines that the temperature in the sauna room B has not reached the maximum value, the controller C proceeds to step 105.

In step 105, the controller C judges whether the cycle time of the selected mode, which starts when the heater 49 is activated, has elapsed or not. If it is determined that the cycle time has elapsed, the controller C proceeds to step 104 and deactivates the heater 49. If it is determined that the cycle time has not yet elapsed, the controller C returns to step 103.

In step 106, the controller C judges whether the temperature in the sauna room B has fallen to the selected mode's minimum value or not. If it is determined that the temperature in the sauna room B has fallen to the minimum value, the controller C proceeds to step 107 and activates the heater again. If it is determined that the temperature in the sauna room B has not yet fallen to the minimum value, the controller C keeps the heater 49 in a deactivated state. The above routine is then repeated consecutively until the user or the timer deactivates the apparatus.

Although only one embodiment of the present invention has been described herein, it should be apparent to those skilled in the art that the present invention may be embodied in many other specific forms without departing from the spirit or scope of the invention. Particularly, it should be understood that the present invention may also be modified as described below.

(1) The present invention may be embodied in a sauna which produces only heated air.

(2) The sauna does not require the cycle time to be set. In this case, the sauna is modified in a manner that the heater 49 is prevented from being deactivated until the temperature in the sauna room reaches the maximum value.

Therefore, the present examples and embodiments are to be considered as illustrative and not restrictive and the invention is not to be limited to the details given herein, but may be modified within the scope of the appended claims.

What is claimed is:

1. A sauna having a substantially airtight room and a heating device, said heating device serving to supply heated air to the room, said sauna comprising:

memory means for storing a plurality of modes, wherein each of said modes includes a maximum value and a minimum value of a temperature range of said room and a predetermined cycle time period;

mode selecting means for selecting a desirable mode for a user of said sauna; and adjusting means for periodically adjusting said temperature in said room by deactivating the heating device when said temperature in said room reaches said maximum value of said selected mode and by activating the heating device when said temperature in said room reaches said minimum value of said selected mode, wherein said adjusting means also deactivates the heating device when said temperature in said room remains below said maximum value of said selected mode for said predetermined cycle time period of said selected mode after activating the heating device.

2. The sauna according to claim 1, further comprising a detecting means to detect whether the temperature in said room reaches the maximum value and minimum value during the predetermined cycle time period.

3. The sauna according to claim 2, wherein said heating device includes a heat insulating case.

4. The sauna according to claim 3, wherein said case accommodates a fan for supplying the air heated by said heating device to said room.

5. The sauna according to claim 4, wherein said case accommodates a tank for storing water and a heater for heating the water into steam, wherein said steam mixes with the heated air before being supplied to said room.

6. The sauna according to claim 5, further comprising a first duct for allowing the passage of the heated air into said room; and a second duct for allowing the discharge of the air from the room, said air having been cooled by heat exchange in said room.

7. The sauna according to claim 6, wherein said first duct comprises means for dispersing the heated air into said room.

8. The sauna according to claim 7, wherein said dispersing means generates a plurality of currents of said heated air in said room, wherein one of said currents is directed toward said second duct to mix with said cooled air and wherein said heated air that is mixed with said steam is directed toward said heating device.

9. The sauna according to claim 8, wherein said case comprises a first fuse to prevent a flow of current in said heating device when the temperature of the surface of the case exceeds a predetermined value.

* * * * *